United States Patent [19]

Ingermann et al.

[11] Patent Number: 4,856,138

[45] Date of Patent: Aug. 15, 1989

[54] BOWLING LANE VACUUM WITH FLOATING HEAD

[75] Inventors: Donald E. Ingermann; Stephen F. Caffrey; Alan R. DeVoe, all of Arvada; Ronald L. Smith, Boulder; Ronald G. Sullivan, Arvada, all of Colo.

[73] Assignee: Century International Corporation, Golden, Colo.

[21] Appl. No.: 274,448

[22] Filed: Nov. 21, 1988

[51] Int. Cl.[4] ..... A47L 5/28

[52] U.S. Cl. ..... 15/320; 15/359

[58] Field of Search ..... 15/320, 359

[56] References Cited

U.S. PATENT DOCUMENTS

| | | | |
|---|---|---|---|
| 2,893,047 | 7/1959 | Swihart | 15/347 |
| 3,402,420 | 9/1968 | Schaeffer | 15/320 |
| 3,559,230 | 2/1971 | Ogle | 15/320 X |
| 3,729,769 | 5/1973 | Sharpless | 15/414 X |
| 4,293,971 | 10/1981 | Block | 15/320 X |
| 4,353,145 | 10/1982 | Woodford | 15/320 X |
| 4,738,000 | 4/1988 | Kubo | 15/98 |

FOREIGN PATENT DOCUMENTS

| | | | |
|---|---|---|---|
| 752514 | 9/1933 | France | 15/359 |

*Primary Examiner*—Chris K. Moore

*Attorney, Agent, or Firm*—Fields, Lewis, Pittenger & Rost

[57] ABSTRACT

An improved bowling lane stripping apparatus is disclosed of the type wherein the squeegee-equipped pickup head whose function it is to wipe the alley free of dirt-laden solvent is pivotally connected to the carriage carrying the power unit such that this head is free to raise up without gouging the lane surface as the carriage support wheels roll down the ramps leading into the gutters alongside the lane thereby causing the unit to tip forwardly. As a further improvement, the pickup head is so weighted and displaced forwardly of its pivotal connection to the carriage a distance chosen to cooperate with the weighted head and define a cantilevered mounting capable of maintaining the squeegee carried thereby in continuous wiping contact with the lane surface that thus becomes effective to remove even puddles and pools of liquid left in depressed areas of the latter.

3 Claims, 2 Drawing Sheets

BOWLING LANE VACUUM WITH FLOATING HEAD

BACKGROUND OF THE INVENTION

Bowling lanes must meet certain criteria established by the American Bowling Congress if the bowler's scores in league play are to be accepted as official, much in the same way as other sports such as golf, baseball, tennis, etc. have rules governing the clubs, the ball, the net height and other factors which if left uncontrolled would lead to unmanageable inequalities among the participants. In the case of bowling, this means cleaning, reoiling and buffing each lane in accordance with strict specifications sometimes as much as two or three times a day depending upon the amount of use and to some extent the caliber of play. In other words, tournament bowlers with high averages probably insist upon more frequent "conditioning" of the lanes than the average bowler engaged in non-league play. Be that as it may, between each such conditioning of the lanes in which they are stripped of the dressing previously applied, resurfaced in the sense of applying a new coat of oil to selected areas and then buffed, they are periodically stripped by applying a solvent followed by a vacuuming operation to remove the dirt and dust that collects and sticks to the oiled surfaces. It is not uncommon, for example, in a well-managed "house" to have all of the lanes dusted at the end of each three-line series in which they were used. Somewhat less often, perhaps once or twice during a twenty-four hour period, each lane is stripped and vacuumed. Following each stripping operation, the lanes must be reoiled in accordance with established American Bowling Congress specifications. The consequence of not properly conditioning the lanes is, of course, erratic and unpredictable ball action during its movement toward the pins and this, in turn, makes for scores that are either higher or lower than they should be.

The method most frequently used for stripping the lanes preparatory to reoiling them is to apply a suitable solvent and then vacuum it up along with the dust, dirt and accumulated oil. The vacuum sweepers customarily used are electrically-powered and guided by spring-biased wheels running in the gutters alongside the lane. Located forwardly of the tank into which is delivered the dust and dirt and used solvent sucked up off the lane is a downwardly-opening manifold extending transversely the 10 full width of the lane. Squeegees made from an elastic material border the intake opening of this manifold and become the elements which actually engage and sweep the wetted surface of the lane as well as adapting to variations in its contour.

The problem with these prior art lane-stripping machines is twofold in that, first of all, they are ineffective in carrying out their primary function, namely, that of cleaning the lanes of debris. Secondly, their design is such that the manifold or pickup head "hangs-up" at the foul line where the guide wheels on the carriage enter and leave the gutters alongside thereof due to the rigid connection between the pickup head and the motorized unit in which the debris is collected thus making it difficult to both move the unit onto the lane as well as remove it therefrom without gouging or otherwise damaging the lane surface. As a Practical matter, bowling lanes are not flat but slightly crowned or dished or both at various areas throughout their length. A rigidly-mounted pickup head would probably be adequate to vacuum up dust and other dry debris, however, such heads have proven to be totally inadequate to suck up small puddles and pools of solvent left in depressions in the lane surface. It also becomes very difficult to clean all the way back to the foul line when the guide wheels are riding up out of or down into the gutters and the head is incapable of accommodating the resulting tilt of the machine.

1. Field of the Invention

The present invention, therefore, relates to improvements in the aforementioned lane-vacuuming equipment, such improvements having to do with the mounting of the nozzle.

2. Description of the Related Art

The most pertinent prior art known to applicant is the lane-stripping apparatus described above which differs from that forming the subject matter hereof in that the pickup head is rigidly attached to the motorized unit housing the tank, motor, vacuum pump and the discharge end of the conduit connected to the nozzle through which the wet debris travels. Accordingly, no novelty is predicated on the apparatus as a whole, but rather, on the pivotal connection of the pickup head which allows it to float, self-adjust to the varying contours of different lanes and, most particularly, permits the lane to be wet-vacuumed all the way back to the foul line while at the same time preventing it from hanging up as its guide wheels enter and are removed from the gutters alongside thereof.

Insofar as prior art patents are concerned that deal with the cleaning of bowling lanes, only two have been found, namely, the early U.S. Pat. Nos. 1,682,168 issued to Dorl and 2,296,994 issued to Grant. Both of these patents, however, deal with mops and not vacuuming equipment yet alone wet vacuums capable of dispensing and sucking up dirt-laden solvent. Neither of these patents discloses a floating head nor would one be required in that they are only designed to pick up dry residues.

Ordinary dry vacuums with adjustable or even floating heads are, of course, known in the art, examples being those shown in U.S. Pat. Nos. 1,136,889; 2,172,973; 2,842,793; 2,850,757; 2,938,225; 3,827,103; 4,580,314 and 4,496,076. While the pickup heads in these prior art machines are generally movable relative to their carriage, they are unsuitable for the wet-vacuuming of a bowling lane. Moreover, the problems inherent in introducing and removing the machine from the lane without its head hanging up and the further problem of picking up pools and puddles of dirt-laden solvent lying in depressed areas are not solved by these machines.

SUMMARY OF THE INVENTION

It has now been found in accordance with the teaching of the present invention that a greatly improved lane-stripping apparatus can be constructed by including the simple, yet unobvious, improvement of mounting the pickup head for movement about a transversely-extending axis of pivotal movement such that it floats atop the lane surface and is self-adjusting to the degree necessary to accommodate the varying lane contours encountered thereby as it traverses the length of any given lane. Specifically, the pickup head or manifold has a generally T-shaped configuration wherein the pivotal connection is made at the base of the stem of the T remote from the crossbar portion thus providing a lever arm of substantial length which allows the head to move up or down the inch or more necessary for it to accommodate the tilt of the machine as the guide wheels enter and leave the gutters without gouging the lane while continuing to effectively sweep the latter all the way back to the foul line. In addition, by moving the mass of the crossbar portion comprising the manifold where the suction is applied out well ahead of its axis of pivotal movement, the weight of the head is concentrated at a remote location where it presses down hard enough to compress and deform the squeegies carried thereby to the degree necessary to enter and wipe up the puddles and pools of dirt-laden solvent remaining caught in depressions in the lane surface.

It is, therefore, the principal object of the present invention to provide a novel and improved bowling lane-solvent stripping apparatus.

A second object is the provision of a device of the type aforementioned which is ideally adapted for use on lanes which are crowned and dished from long term use and, therefore, are in need of resurfacing.

Another object of the within-described invention is to provide a lane-stripping unit in which the pickup head yields to accommodate the tilt of the machine encountered when its guide wheels enter and leave the gutters alongside the lane.

Still another objective is the provision of floating-head wet-vacuuming apparatus in which the head is cantilevered and weighted to maintain a pressure on the lane surface sufficient to deform the flexible elastic squeegies and maintain the latter in wiping contact sufficient to remove any puddles.

An additional object is to provide a device of the type disclosed and claimed herein which is self-adjusting and, therefore, does not require resetting its pickup head to accommodate differing lane conditions and surface irregularities.

Further objects are to provide an apparatus of the character described which is simple yet efficient, safe, easy to operate, versatile, reliable and even somewhat decorative.

Other objects will be in part apparent and in part pointed out specifically hereinafter in connection with the description of the drawings that follows.

DESCRIPTION OF THE PREFERRED EMBODIMENTS

Figure 1:
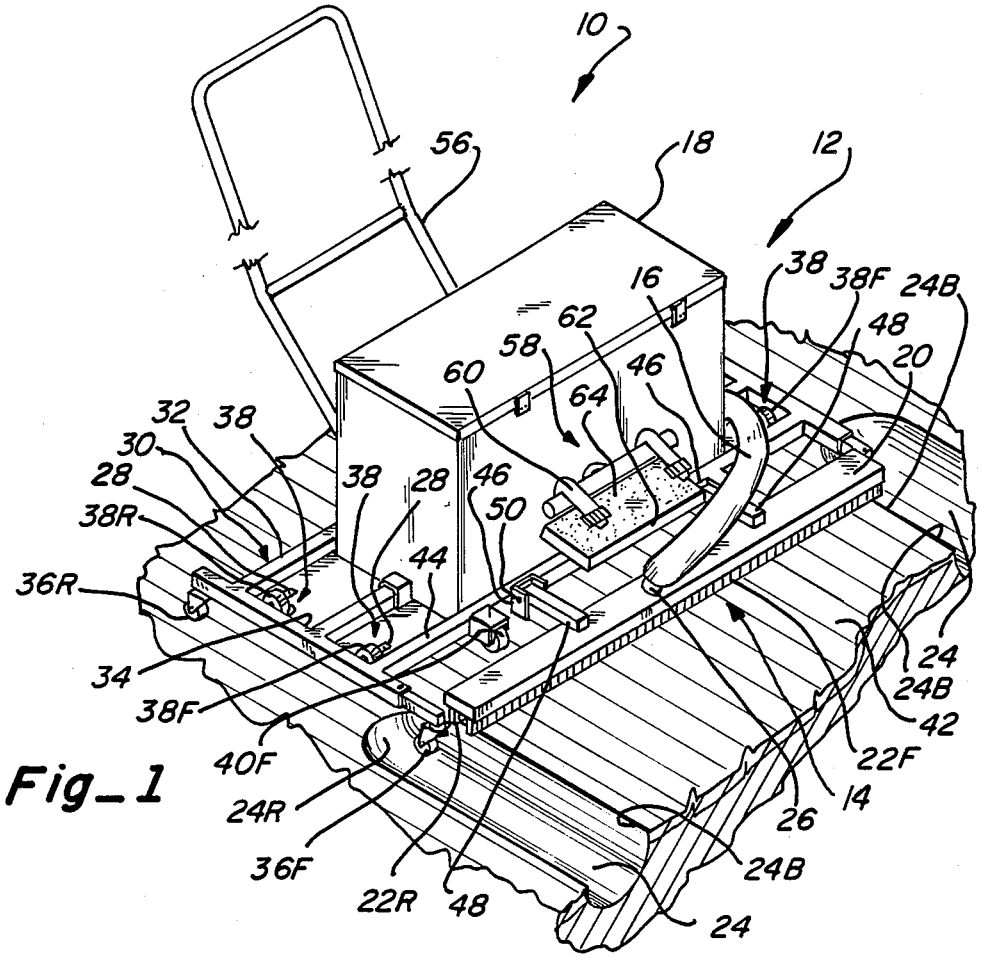
FIG. 1 is a perspective view showing the bowling-lane solvent-stripping apparatus located at the foul line with its guide wheels positioned on the ramps leading down into the gutters, portions having been broken away to conserve space.

Referring next to the drawings for a detailed description of the present invention and, initially, to FIG. 1 for this purpose, reference numeral 10 has been chosen to broadly designate the lane-stripping apparatus forming the subject matter hereof while reference numerals 12 and 14 have been employed to similarly connote the power unit and the wet pickup head, respectively. Power unit 12 is conventional and it includes an electrically-powered suction pump of some description (not shown) which is connected to the pickup head by a flexible hose 16. The solvent-laden dust and other debris sucked up by the pickup head passes through the suction pump and is deposited in an appropriate refuse tank (also not shown) housed inside housing 18 along with the necessary wiring, switches, etc. necessary to control the operation of the machine.

Pickup head 14 is, likewise, conventional in the sense that it includes a downwardly-opening manifold 20 bordered both front and rear in the particular form illustrated by squeegee-type wipers 22F and 22R formed of rubber or some other elastic material which will deform to the degree necessary to accommodate both crowned and dished lane surfaces while remaining in wiping contact therewith especially in the depressed areas where pools and puddles of fluid will collect. This manifold 20 extends the full width of the lane and preferably an inch or so beyond and out over the gutters 24 in order to insure that the entire lane surface is swept and wiped even though the apparatus veers from side-to-side slightly within the limits permitted by the guidance apparatus soon to be described while being pushed by the operator.

Centered between the ends of the manifold and in communication with the underside thereof is a hollow tubular neck 26 which collects the solvent-laden dust and debris sucked up by the pickup head and transfers it to the hose connected thereto in the well known manner. Variations in both the pickup head and the power unit will readily occur to those skilled in the art while preserving the novelty present in the pivotal connection therebetween and the forwardly-cantilevered mounting which both permits the head to float and, in addition, presses it down tightly against the surface of the lane regardless of irregularities in its surface contour. Before examining this novel connection, however, it will be well to first examine the carriage supporting the power unit which creates the problems solved by the floating head, this carriage having been broadly designated herein by reference numeral 30 and shown in part at least in all the figures of the drawing.

Carriage 30 includes a horizontally-disposed generally rectangular frame 32 having a sideframe members 34 which mount front and rear pairs of casters 36F and 36R so spaced that they ride within the gutters alongside the lane when the machine is in its operative position forwardly of the foul line. With the machine properly centered on the lane, these casters will lie out of contact with the bottom of the gutters and thus become inoperative. On the other hand, with the apparatus removed from the lane and onto the approach areas behind the foul lines, these casters 36 are so disposed beneath the frame supporting the power unit 12 that they lift the latter along with the pickup head 14 pivotally attached to it up off the ground thereby facilitating the movement of the apparatus from one lane to another. In the particular form illustrated, sideframe elements 34 are shown to be telescopable so that the front pair of casters 36F can be adjusted relative to the pickup head 14 which is fixed insofar as its position ahead of the power unit is concerned. Alternatively, of course, the pickup head could be mounted for adjustable movement to-and-fro relative to the power unit therebehind.

Figure 2:
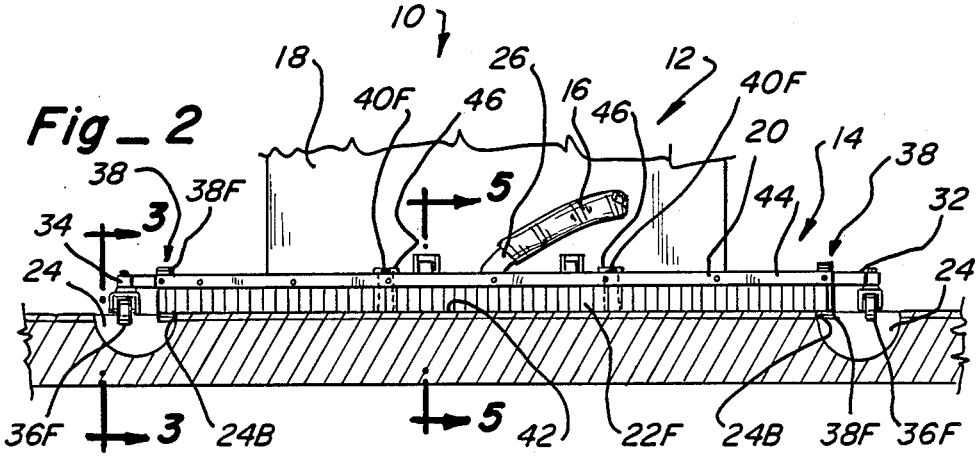
FIG. 2 is a fragmentary front elevation showing the front pair of guide wheels riding down the ramps leading into the gutters while the rear set remain in the approach area behind the foul line.
Figure 3:
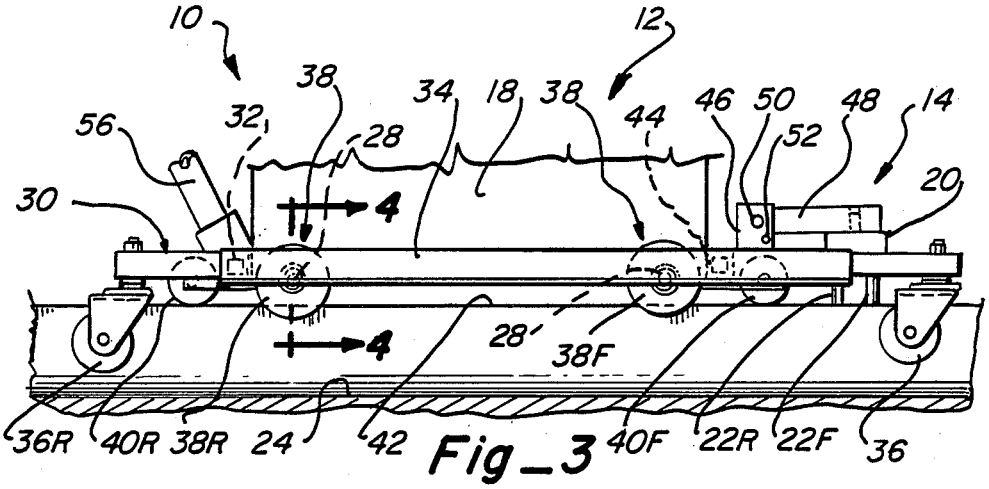
FIG. 3 is a fragmentary side elevation to an enlarged scale taken along line 3—3 of FIG. 2.
Figure 4:
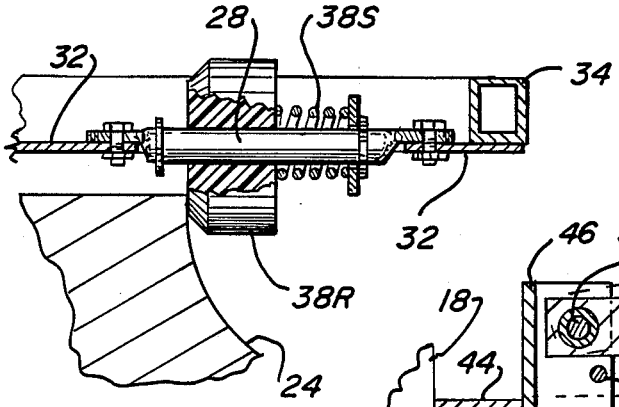
FIG. 4 is a fragmentary section to an enlarged same scale taken along line 4—4 of FIG. 2.
Figure 5:
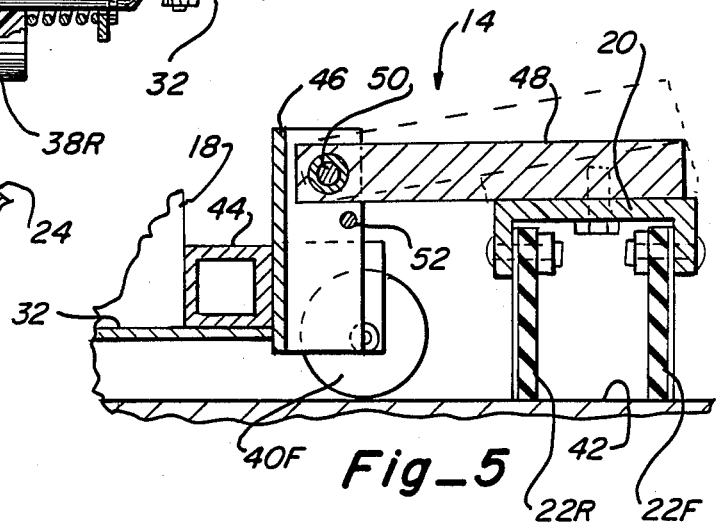
FIG. 5 is a section taken along line 5—5 of FIG. 2 to approximately the same scale as FIG. 4; and, FIG. 6 is a fragmentary side elevation much like FIG. 3 and to the same scale but differing therefrom in that the apparatus is shown tilted forward with its front guide wheels down in the gutters alongside the lane being vacuumed.
Figure 6:
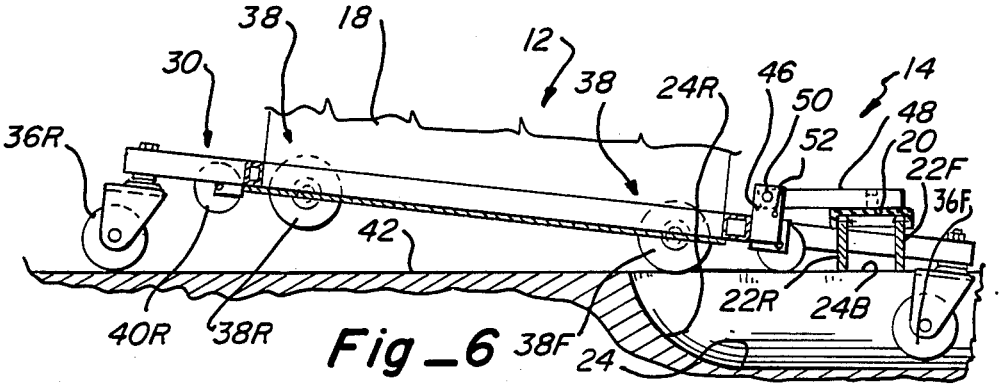

Directing attention specifically to FIGS. 1–4 and 6, it will be seen that the frame also carries front and rear pairs of guidewheels 38F and 38R mounted inboard of the caster pairs 36 in position to ride down in the gutters in rolling contact with the inner edges of the latter as seen most clearly in FIG. 2. These wheels 38 are not casters mounted for pivotal movement about a vertical axis as are caster sets 36, but instead, they comprise parts of guidewheel subassemblies that have been indicated broadly by reference numeral 38 and which are each journalled for rotation on axles 28 carried by the frame (see FIG. 4) for adjustable movement toward and away from one another to accommodate slight variations in gutter spacing. Guidewheels of this type are well known in lane-stripping machines and they oftentimes include inside beveled edges and springs 38S biasing them toward one another and into contact with the inside edges of the gutters. Their function when so disposed in position engaged along the inside edges 24B of the gutter is exclusively one of guiding the unit along the center of the lane. The rear pair of guidewheels 38R are located within the frame forwardly of the rear pair of casters 36R while the front pair lie in rearwardly-spaced relation to the front pair of casters 36F. This being the case, as the front pair of casters drop off the end of the approach area at the foul line and enter the gutters after rolling down the ramps 24R leading down into the latter, the front pair of guidewheels 38F function to briefly support the front end of the apparatus as it tilts forward as seen in FIG. 6 before the front pair of support wheels 40F take over and drop down into engagement with the lane surface 42. This is one of the points at which those existing lane-stripping machines with fixed heads drop down and hang up, sometimes even scraping the lane surface just forwardly of the foul line. As will be explained presently, the floating head design of the present invention solves this problem while, at the same time, permitting the machine to clean the lane all the way back to the foul line which is virtually impossible to do effectively with the machines having a rigid or fixed head as opposed to a floating one. With specific reference to FIG. 6 it will be apparent that as the front pair of casters 36F descend the ramp 24R leading down into the gutter, the front pair of carriage support wheels drop down into engagement with the lane surface 42 thus permitting the head 14 which is pivotally attached to the frame in a manner soon to be described to drop down into its operative sweeping and wiping position shown in FIGS. 2–5, inclusive.

FIGS. 1 and 6 to which detailed reference will now be made best show the pivotal connection by means of which the pickup head 14 is connected to the front crossframe element 44 of the frame 32. In the particular form shown, a pair of channel-shaped mounting brackets 46 are welded or otherwise fastened to the aforementioned crossframe member in transversely-spaced relation on opposite sides of the fore/aft centerline of the frame with their channels opening forwardly and the flanges thereof extending vertically to receive the rear ends of the arms 48 therebetween where they are hingedly attached to pivot pin subassemblies 50 for movement between the upper and lower positions of FIG. 6 shown in phantom lines. A stop pin 52 carried by at least one of the brackets 46 and disposed forwardly and slightly beneath the pivot pin subassemblies 50 engages the underside of the arm 48 associated therewith thus limiting how far down the pickup head 14 can drop to a level which leaves it raised clear of the floor when wheeled from one location to another on the casters 36. While less necessary, the web-forming portions of the brackets 46 can be used as stops limiting the degree to which the pickup head can be elevated by selecting the location of the pivot pin subassemblies 50 relative to the rear end of the arms 48 such that the latter engage these bracket flanges, or at least one of them in the manner seen in FIG. 6.

The manifold 20 of the pickup head 14 is attached to the front ends of the arms 48 well in front of their hinge axes thus providing a forwardly-cantilevered mounting for the pickup head effective to press its squeegees down into continuous wiping contact with the lane surface all the way from one side to the other despite any irregularities therein caused by ball wear, the build-up of oil and other lane finishing materials or other factors. The combined weights of the manifold, the arms, the fasteners 52 attaching the manifold to the arms, the neck 26 and the hose 16 attached to the latter all combine and cooperate with the easily deformed squeegees to provide an assembly sufficiently heavy and so positioned that it floats out ahead of the carriage and remains at all times in continuous sweeping as well as wiping contact with the lane surface. Moreover, the cantilevered system just described is self-adjusting to varying conditions seen on the same or different lanes without requiring the intervention of the operator. Additional weight can, of course, be added to the pickup head should the situation arise in which the brushes are not, in fact, maintaining proper lane contact.

Returning once again briefly to FIG. 1, it will be seen that the unit is hand-propelled by means of a conventional handle 56 attached to the carriage. The subassembly designated in a general way by reference numeral 58 and shown attached to the front wall of the housing comprises a pair of spray nozzles 60 connected to receive solvent from a supply thereof (not shown) contained within the power unit housing. These nozzles dispense solvent out ahead of the pickup head in a generally fan-shaped spray. Shown disposed beneath the nozzles is a shallow basin 62 containing a sponge 64 for catching any drippings that might otherwise find their way down onto the lane surface.

We claim:

1. In an apparatus for applying a solvent to a bowling lane and wet-vacuuming the solvent-laden residues therefrom that includes a carriage having front and rear transversely-spaced pairs of carriage-support wheels located fore and aft thereof which are positioned and adapted to roll down the ramps leading into the gutters alongside the lane a pair at a time sequentially, a power unit mounted atop the carriage containing both solvent-dispensing means for placing solvent onto the lane to be cleaned as well as vacuuming means for sucking up and storing the wet residues left on the lane surface, and a pickup head operatively connected to the vacuuming means and movable with the carriage for squeegeeing the lane surface free of all liquid and solid residues, the improvement which comprises: pivotally attaching the pickup head to the carriage for hinged movement about a transverse axis spaced behind the latter a distance selected to permit said head to yield and raise up without damaging the lane surface while remaining in continuous side-to-side wiping contact therewith as the carriage-support wheels enter the gutters causing the carriage and power unit supported thereon to tip forwardly.

2. The improvement as set forth in claim 1 which includes the further improvement of: weighting the pickup head and spacing it forwardly of its pivotal connection with the carriage a distance selected such that a free-floating cantilevered mounting is produced capable of self-adjusting and maintaining sufficient continuous wiping contact with the lane surface effective to suck up puddles and pools of liquid left in depressed areas of the latter.

3. The improvement as set forth in claim 1 which includes the further improvement of: a stop-forming means positioned and adapted to engage the pickup head and prevent same from touching the ground when the carriage-support wheels lie outside the gutters.

* * * * *